US006591637B2

(12) United States Patent
Jürgens

(10) Patent No.: US 6,591,637 B2
(45) Date of Patent: Jul. 15, 2003

(54) PLATE FOR CLOSING THE TOE OF HOSIERY

(75) Inventor: Eric Jürgens, Bissingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/271,749

(22) Filed: Oct. 17, 2002

(65) Prior Publication Data

US 2003/0074929 A1 Apr. 24, 2003

(30) Foreign Application Priority Data

Oct. 17, 2001 (DE) ..... 101 50 684

(51) Int. Cl.[7] ..... D04B 15/02
(52) U.S. Cl. ..... 66/148
(58) Field of Search ..... 66/147, 148, 58, 66/95

(56) References Cited

U.S. PATENT DOCUMENTS 5,761,931 A * 6/1998 Lonati et al. ..... 66/148
5,816,075 A * 10/1998 Lonati et al. ..... 66/28
5,855,122 A * 1/1999 Lonati et al. ..... 66/95
6,176,106 B1 * 1/2001 Lonati et al. ..... 66/95

FOREIGN PATENT DOCUMENTS

| | | |
|---|---|---|
| DE | 1 906 131 | 11/1969 |
| DE | 1 906 132 | 7/1970 |
| EP | 0 942 086 A2 | 9/1999 |

* cited by examiner

*Primary Examiner*—Danny Worrell
(74) *Attorney, Agent, or Firm*—Venable; Norman N. Kunitz

(57) ABSTRACT

A closing device (4) is provided for closing a tube-shaped knit fabric on one end, for example for producing stockings or socks, which has plates (9) and counter-plates (13). The latter each have loop-carrying sections (18, 41), whose ends are designed to be complementary to each other and can engage each other in an interlocked manner. Here, the plates (9) have a receiving end, and the counter-plates (13) a penetrating end. The receiving end is constituted by a receiving funnel (28), formed by the ends of two legs (22, 23). These can be resiliently bent away from each other. This has the advantage that the penetrating counter-plate (13) cannot cause any damage to the plate (9) if it is moved too far in the direction toward the plate (9). There is the further advantage that in the course of the dipping movement of the needle into the free space of the plate, as well as during the relative movements between the needle and the plate, damages are almost impossible.

19 Claims, 6 Drawing Sheets

PLATE FOR CLOSING THE TOE OF HOSIERY

FIELD OF THE INVENTION

The invention relates to a plate for a closing device for closing a tube-shaped knit fabric, in particular in connection with the manufacture of hosiery.

BACKGROUND OF THE INVENTION

As a rule, hosiery is produced on special circular knitting machines. For finishing the stockings in the toe area, it is necessary to close the initially tube-shaped stockings. It is important here to sew the oppositely located portions of the last row of loops together.

A device for this purpose is known from EP 0 942 086 A2, which has a plate carrier which is ring-shaped as a whole. The plate carrier is provided with individual plates which are housed in radially arranged slits and are used to remove the last row of loops from the knitting needles. To do this, the needle hooks of the knitting machine needles which hold the loop to be transferred dip into the free spaces of the plates. In the course of transferring the loop from the needle to the plate, the needle with the inserted head moves in relation to the plate. This course of movement, the relative movement between the needle and the plate, as well as the dipping movement, must be highly precise. Otherwise the needle and the plate collide, which can lead to damages, even to functional losses because of the breaking of the needle, or of the plate.

The plate carrier is divided into two parts and therefore consists of two half-rings. These can be flipped together by means of an appropriate guide and drive mechanism. In the process oppositely located plates of the plate carrier are brought together until their loop carrier sections touch. Oppositely located loops are brought together in this way, after which their are connected by a seam.

The respective plates are designed complementary in pairs. While one plate has a protrusion, the oppositely located plate has a recess, wherein the protrusion and the recess engage each other when the two ring halves of the plate carrier are flipped toward each other. In order not to damage the plates here, a high degree of precision is required in guiding and moving the plate carriers. The operating speed of the arrangement is substantially affected by this precision.

OBJECT AND SUMMARY OF THE INVENTION

Based on the foregoing, it is the object of the invention to design plates for a closing device for closing a tube-shaped fabric in such a way that an increased operating speed is made possible and/or the requirement for precision in the course of the movement and positioning of the plate carrier and/or the needle can be reduced.

This object is attained by means of a plate in accordance with claim 1.

The plate in accordance with the invention has a base section and a loop-carrying section extending away from it. The loop-carrying section is constituted by two legs, which are arranged spaced apart from each other and whose ends are curved toward each other, touch at one place and then diverge away from each other in order to form a receiving funnel. The latter is used for receiving a corresponding tip of a complementary and associated counter-plate when loops are to be transferred. The legs of the plate with the funnel are not connected at the base of the funnel, i.e. at the place where they touch. This has the substantial advantage that the complementary counter-plate can move with its tip into the funnel without damaging the funnel bottom. Therefore larger tolerances in regard to positioning are possible. If the tip of the complementary counter-plate is inserted by a few tenths of a millimeter deeper into the funnel than expected, the legs of the funnel can be slightly spread apart without damage being caused to the funnel bottom or the complementary plate tip.

This can under certain circumstances also allow an increase in the operating speed and in the end permits an increase of the seam quality, since seam errors, such as can occur if the plate is damaged and the respective loop is no longer correctly transferred, can be excluded to a large degree.

It is considered to be advantageous if the legs not only come very close to each other at the narrow place, but touch, so that they preferably rest resiliently against each other. It is preferred for them to rest under pretension against each other. In this way the two legs constitute a relatively stiff and stable eye, but can be spread apart from each other if an element penetrates into the funnel.

The receiving funnel preferably opens at an angle between 20° and 40°. The opening angle is preferably fixed at approximately 30°. This provides good guidance for the plate and counter-plate when they are moved engagingly together for transferring a loop.

The legs of the plate, as well as the legs of a corresponding counter-plate, are preferably embodied as one piece with the respective base section, wherein their thickness is preferably less than half the thickness of the base section. This results in a compact, altogether stiff element, with good lateral resilience in the area of the loop-carrying section. Moreover, the loop-carrying section is therefore hardly wider than a knitting needle from which the loop is transferred. This occurs even though the legs of the loop-carrying section define a free space between them, into which the head of the knitting needle can extend. In this way it is possible to transfer loops from the knitting needle to the loop-carrying section without being stretched.

The counter-plate associated with the plate differs from the plate at least to the extent that the legs, which initially extend at a distance from each other, are curved toward each other at the ends and touch in one place without forming a funnel. They terminate in a common edge at the place of contact, which fits into the funnel of the plate. In this way the counter-plate is designed complementary to the plate.

The two legs of the counter-plate can be connected with each other at their ends, or simply rest against each other. In the latter case they preferably rest under pretension against each other. But if they are connected with each other, a stiffened loop-carrying section is the result.

The narrow sides of both plates (plate and counter-plate) are preferably provided with a groove extending as far as into the loop-carrying section. The groove is preferably provided with groove walls which diverge from each other in order to ease the transfer of the loop to a sewing device. In that case the sewing device has corresponding loop-pickup fingers, which brush through the groove. The diverging groove walls make the introduction of the respective fingers into the groove easier.

The flexible design of the legs and their loose contact in the end area has the advantage that the legs can flexibly yield when the head of the needle touches. Therefore it is possible to reduce the requirements made on the precision of the needle and plate guidance.

Further details of advantageous embodiments of the invention ensue from the dependent claims, the drawings, or the description. An exemplary embodiment of the invention is illustrated in the drawings.

DETAILED DESCRIPTION OF THE PREFERRED EMBODIMENT

Figure 1:
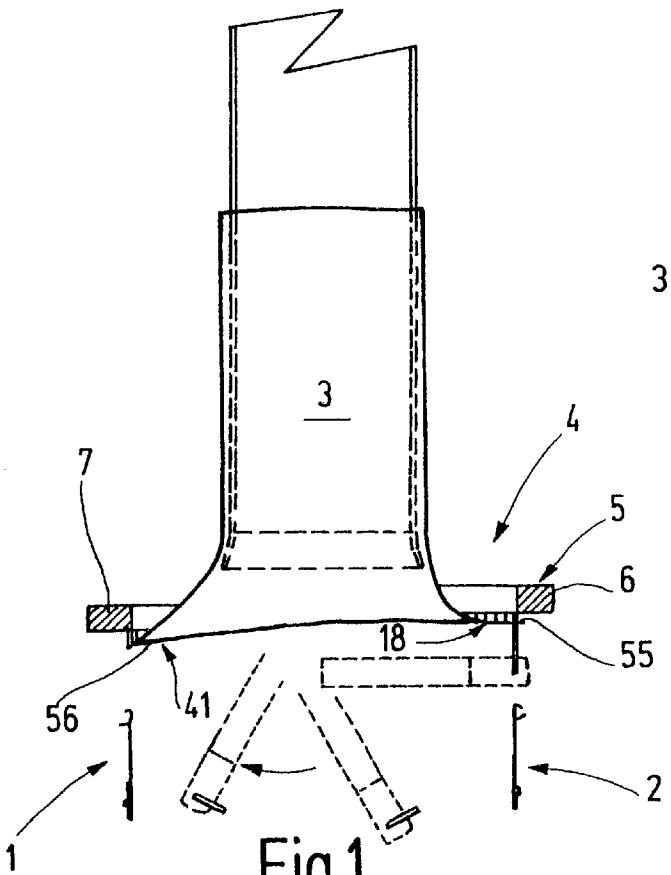
FIG. 1 shows a circular knitting machine for tube-shaped goods, for example hosiery, in a extremely schematized representation, and a closing device for bringing oppositely located knit elements of a stocking together.

A portion of a knitting machine is illustrated in greatly schematic form in FIG. 1 by means of two needles 1, 2, which are located opposite each other and, like other needles which are not represented, are guided in a longitudinally displaceable manner in a needle cylinder and driven by a cam. The needles 1, 2, as well as the other needles, are used, together with further knitting tools, such as plates, hold-downs and the like, to produce a tube-shaped knit fabric 3, from which a stocking is produced. For this purpose the loops of the tube-shaped knit fabric 3 must be taken off the needles 1, 2 and placed on top of each other. A closing device 4 is used for this, part of which is a ring-shaped plate carrier 5. The latter has two plate carrier sections 6, 7, each of which is curved in a semicircular shape and which can be, as shown by dashed lines in FIG. 1, swiveled toward and away from each other by means of a positioning device, not further represented. The swivel axis lies in a common plane with the ring-shaped plate carrier and extends perpendicularly in the drawing plane of FIG. 1.

Figure 5:
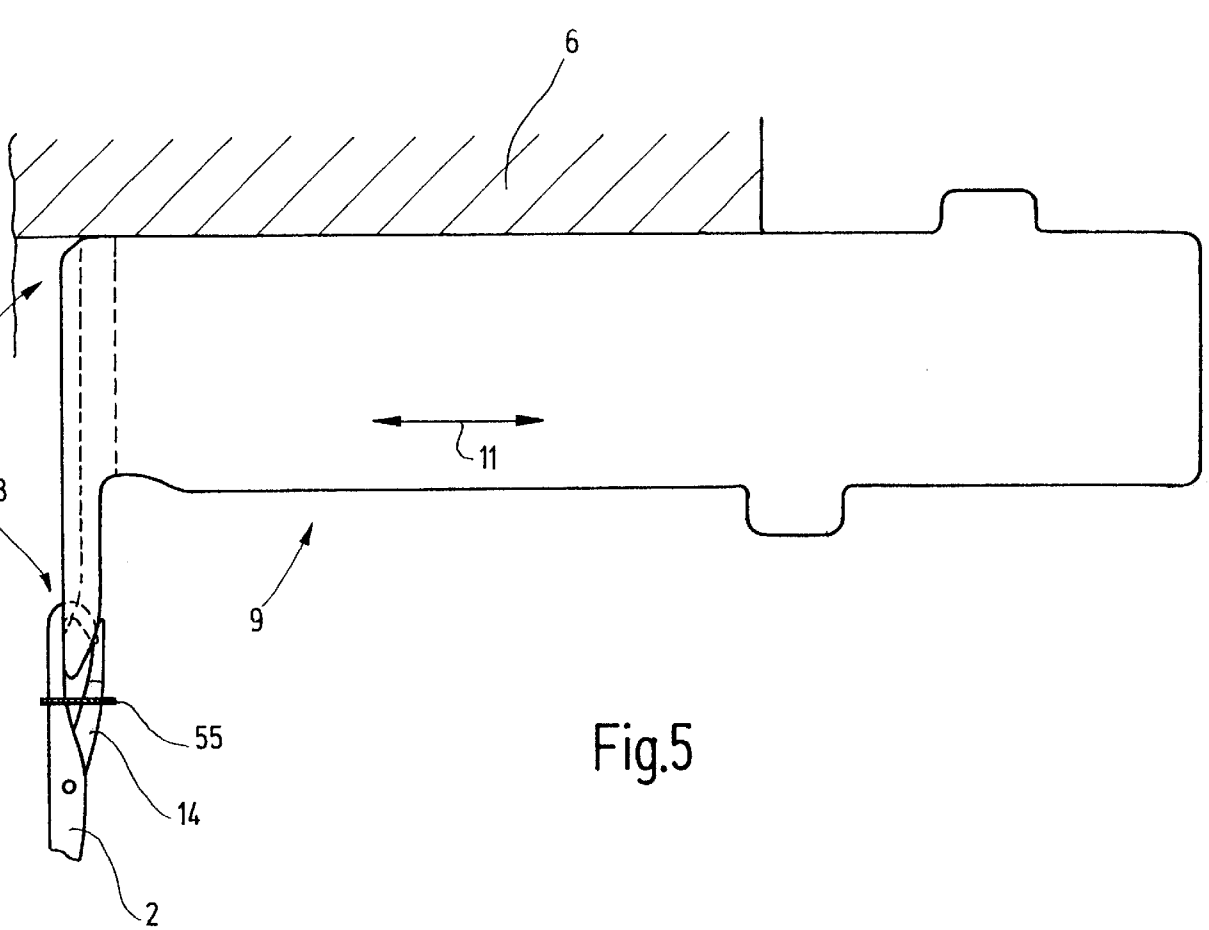
FIG. 5 is a lateral view of the needle and the plate during the loop transfer.
Figures 7, 8:
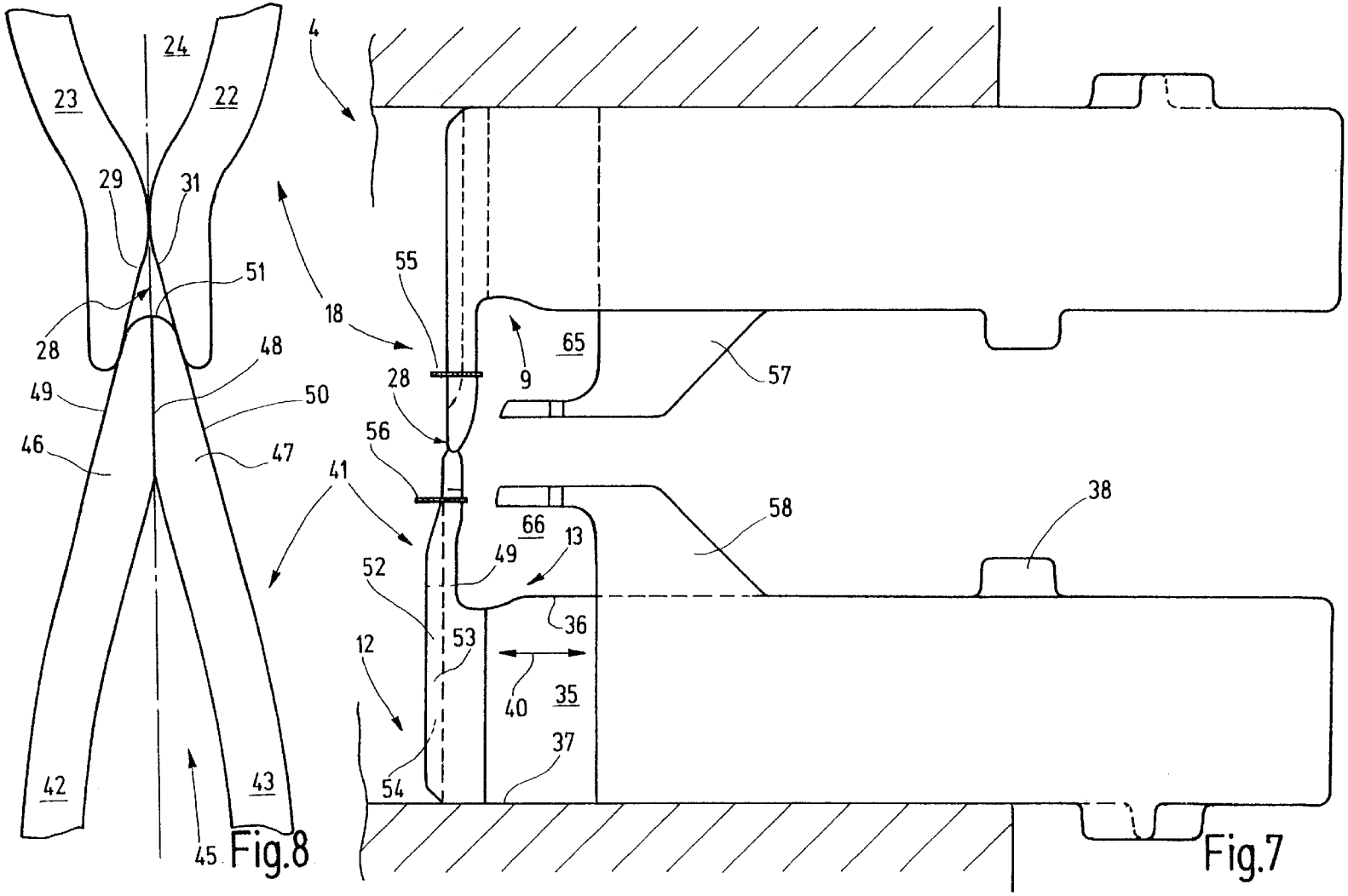
FIG. 7 is a lateral view of the plate in FIGS. 4 to 6 and an associated counter-plate swiveled against it in the engagement state, with the closing plate.
FIG. 8 is a view from above on a different scale on the plate and the counter-plate in FIG. 7 in the engaged state.

The plate carrier section 6 is provided with radially extending guide channels 8, in each of which a plate 9 is displaceable along its longitudinal axis 11, as illustrated in FIG. 5, i.e. it is seated longitudinally displaceable. The plate carrier section 7 is correspondingly provided with radially extending guide channels 12, in which counter-plates 13, as well as closing plates 58, are seated longitudinally displaceable (FIG. 7).

Figures 4, 4A:
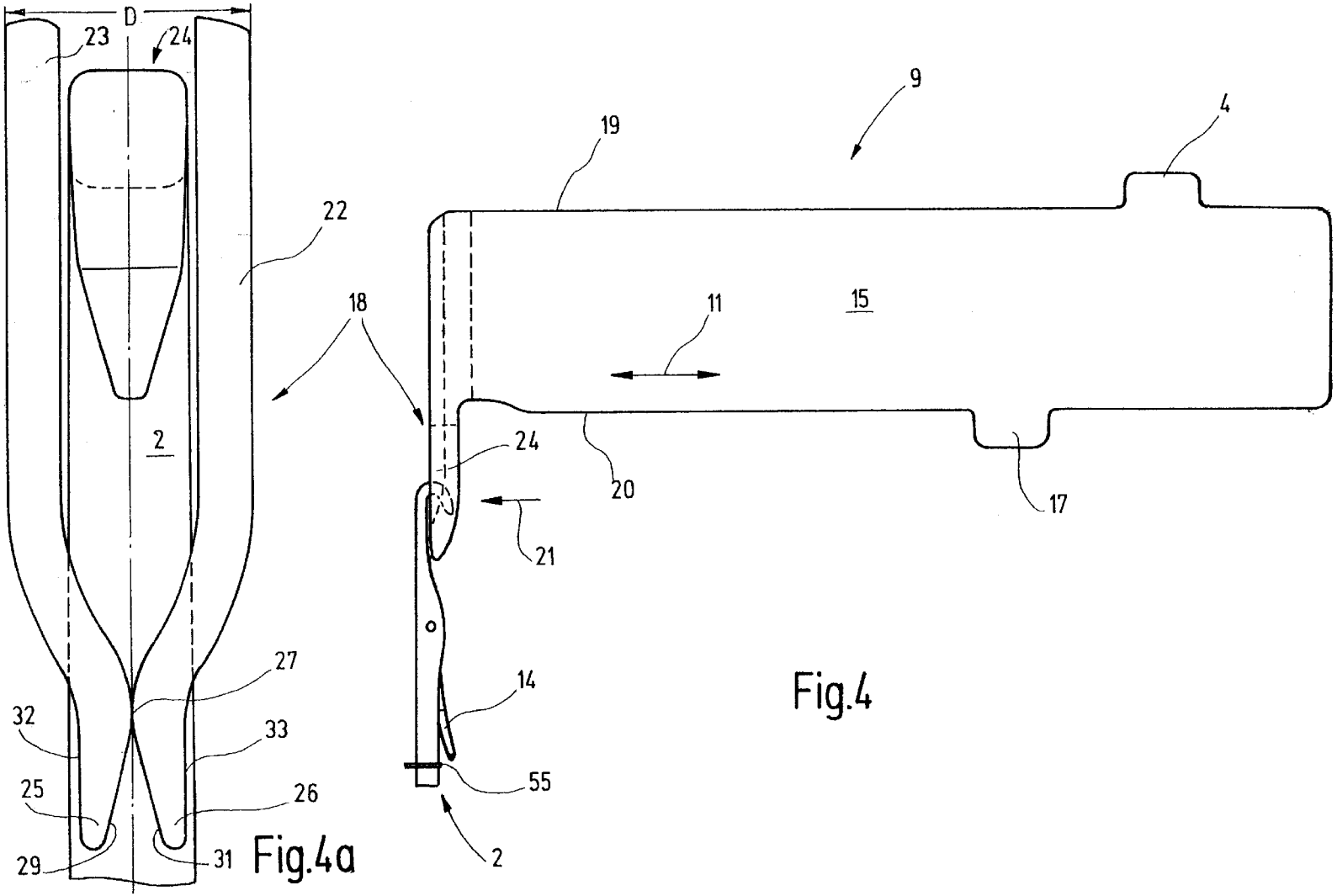
FIG. 4 is a lateral view of a needle and a plate prior to the transfer of the loop.
FIG. 4*a* is a view from above on the needle and plate in FIG. 4 on a different scale.

The plate 9 will be described in greater detail in what follows:

FIG. 4 illustrates the plate 9 in a lateral view and interacting with the needle 2, which is represented as a latch needle with an open latch 14. The plate 9 has a base section 15, for example approximately rectangular, from whose long narrow sides two feet 16, 17 extend. A loop-carrying section 18 adjoins an end of the base section 15 which is remote from the feet 16, 17, and extends transversely to the longitudinal direction 11 of the plate 9 and therefore transversely to its long edges 19, 20. FIG. 4*a* illustrates the loop-carrying section 18, viewed in a direction in accordance with the arrow 21 in FIG. 4. It is formed by two legs 22, 23 which extend away from the base section 15 at approximately right angles and define a free space 24 between themselves. The latter is of such a size that the head of the needle 2 can enter into the free space 24 without spreading the legs 22, 23 away from each other.

As can be seen in FIG. 4, the legs 22, 23 have a constant height over a considerable portion of their length. Moreover, in accordance with FIG. 4*a* they extend spaced apart and parallel with each other. However, in the vicinity of their ends 25, 26 they are bent toward each other and converge until they rest against each other at a location 27. The legs also have a substantially constant thickness up to this location 27. It is less than half the thickness of the base section 15, whose thickness D preferably approximately corresponds to the distance of the outer flanks of the legs 22, 23 from each other.

Starting at the location 27, the legs 22, 23 become narrower up to their respective ends 25, 26, so that together they define a receiving funnel 28, which opens longitudinally toward the loop-carrying section 18, and therefore longitudinally toward the needle 2. The receiving funnel 28 has inner flanks 29, 31, which between themselves enclose an acute angle between 20° and 40°. Preferably the angle is 30°. The legs 22, 23 furthermore have outer flanks 32, 33 in the area of the receiving funnel 28, which are aligned approximately parallel in relation to each other. Thus, as a whole the legs 22, 23 are curved in the form of a letter S in opposite directions in the area of their ends 25, 26 and are shaped mirror-reversed in respect to each other. At the location 27 they rest resiliently under pretension against each other. As can be seen in FIGS. 4 and 4*a*, their free ends are rounded in a lateral view as well as in a view from above.

The counter-plate 13 will be described in what follows. It can be viewed in FIG. 7. It has a base section 35 which, in a lateral view, is embodied to be approximately rectangular and has two long edges 36, 37. Two feet 38, 39 extend away from these, which are used for moving the counter-plate 13 in its longitudinal direction 40. A loop-carrying section 41 extends transversely in respect to the edges 36, 37, as well as the longitudinal direction 40. It is formed by two legs 42, 43, as can be seen in FIG. 8, both of which are connected in one piece with the base section 35.

They are attached to the base section 35 at a location 44 which lies at approximately the same height with the long edge 36.

The legs 42, 43 extend parallel and spaced apart from each other and define a free space 45 between themselves. The latter is designed completely analogous to the free space 24 and is therefore of sufficient size, so that a needle head can enter it without spreading the legs 42, 43 apart.

In the vicinity of their respective ends 46, 47 remote from the location 44, the legs 42, 43 are curved toward each other in order to close the free space 45. Moreover, they extend with substantially constant thickness over the entire length of the free space 45, wherein they rest against each other with their ends 46, 47 in a contact area 48. The ends 46, 47 are flattened in the contact area in such a way that their outer flanks 49, 50 are embodied to be nearly straight and run toward each other at an acute angle. Thus, they terminate in a common rounded edge 51, whose radius of curvature is.so small that it can enter into the receiving funnel 28 without stretching it. Finally, the width of the loop-carrying section 41 at the edge 51 is less than the width of the receiving funnel 28. The angle enclosed by the flanks 49, 50 preferably matches the angle enclosed by the flanks 29, 31 at least approximately.

The legs 42, 43 can be connected with each other in the contact area 48. But preferably they only rest against each other under resilient pretension.

A longitudinal groove 52, bordered by two groove walls 53, 54, extends over a portion of the length of the loop-carrying section 41, as well as over the narrow side of the base section 35. The walls 53, 54 diverge from each other in relation to the longitudinal direction 40 and in this way form a receiver for guiding a tool intended to take off loops 55, 56 from the counter-plate 13.

Figure 9:
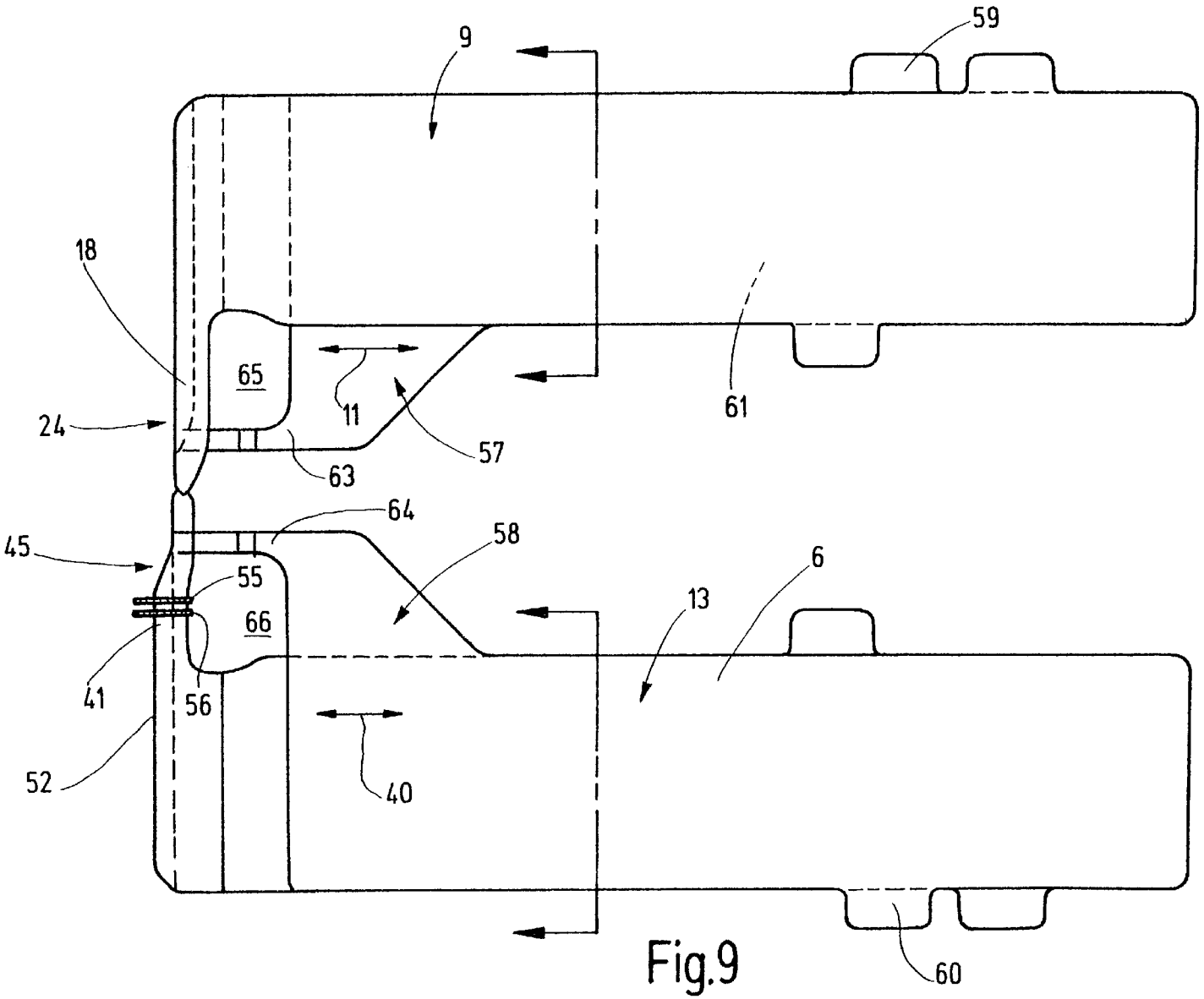
FIG. 9 is a lateral view of the plate, the counter-plate and the closing plates following the transfer of the loops to the counter-plate.

Furthermore, closing plates 57, 58, which can be seen in FIG. 9, are a part of the closing device 4. One closing plate 57, 58 is assigned to each plate 9 and each counter-plate 13. They have a base section 61, 62 provided with a foot 59, 60, from which a finger-like protrusion 63, 64 extends parallel in respect to the respective longitudinal direction 11, 40 in such a way that it can be moved into the respective free space 24, 45, and again out of it. In the course.of this a loop-holder space 65, 66, formed between the loop-carrying section 18, 41 and the protrusion 63, 64, is respectively opened and closed.

Figure 5A:
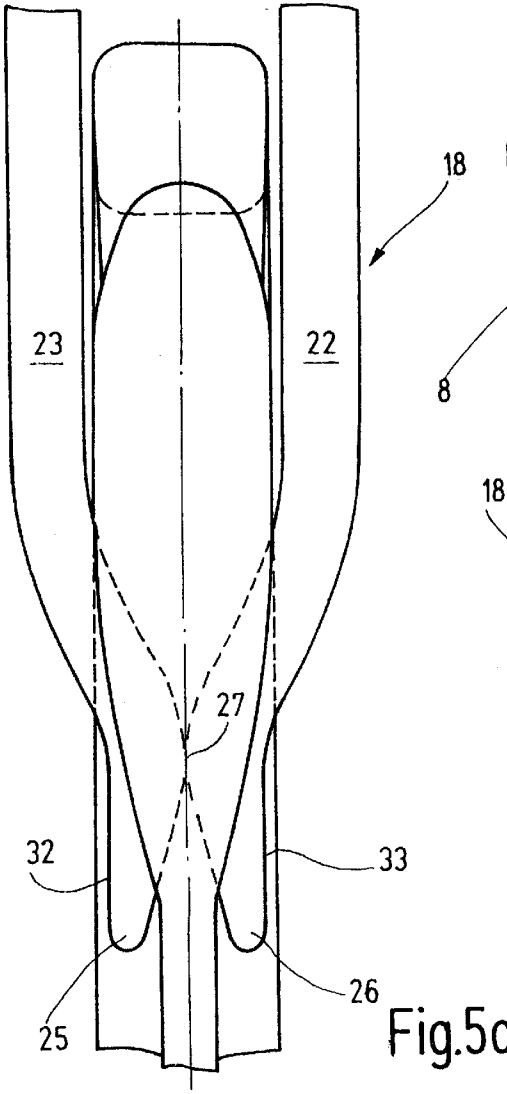
FIG. 5*a* is a view from above on the needle and plate in FIG. 5 on a different scale.

The closing device so far described operates as follows:

As illustrated in FIG. 1, the last row of loops of the knit fabric 3 is transferred from the needles 1, 2, as well as further needles, not represented, initially to the loop-carrying sections 18, or 41, of the plates 9 and counter-plates 13. This process is illustrated in detail by means of the example of the plates 9 in FIGS. 4 to 6. As illustrated in FIG. 4, the needle 2 is driven out and the plates 9 is moved to the left in the longitudinal direction 11 in FIG. 4, so that the loop-carrying section 18 receives the head (hook) of the needle 2 in its free space 24. In this case the loop 55 lies on the needle shank and the latch 14 is open. By means of a suitable relative movement between the knit fabric 3, the needle 2 and the plate 9, the loop 55 is now transferred to the loop-carrying section 18. For example, this can take place in that the needle 2, together with the plate carrier section 6, and therefore with the plate 9, is moved in the longitudinal direction of the needle. In the example shown in FIG. 4, this is a movement vertically downward. Therefore the loop 55, as illustrated in FIG. 5, closes the latch 14, which therefore rests on the tip of the hook protruding through the free space 24. Thus, the ends 25, 26 extend into the now closed thread space of the needle 2, as shown in FIGS. 5*a* and 4*a*. The distance of the flanks 32, 33 from each other is less than the width of the shank of the needle 2. Therefore the ends 25, 26 do not extend past the sides of the needle, so that the loop 55 can slide on the loop-carrying section 18 without bumping against the ends 25, 26. This is made possible in particular because of the reduced thickness of the legs 22, 23, as well as the rounded, transition- and step-free embodiment of the outer flanks 32, 33 of the legs 22, 23.

Figure 6:
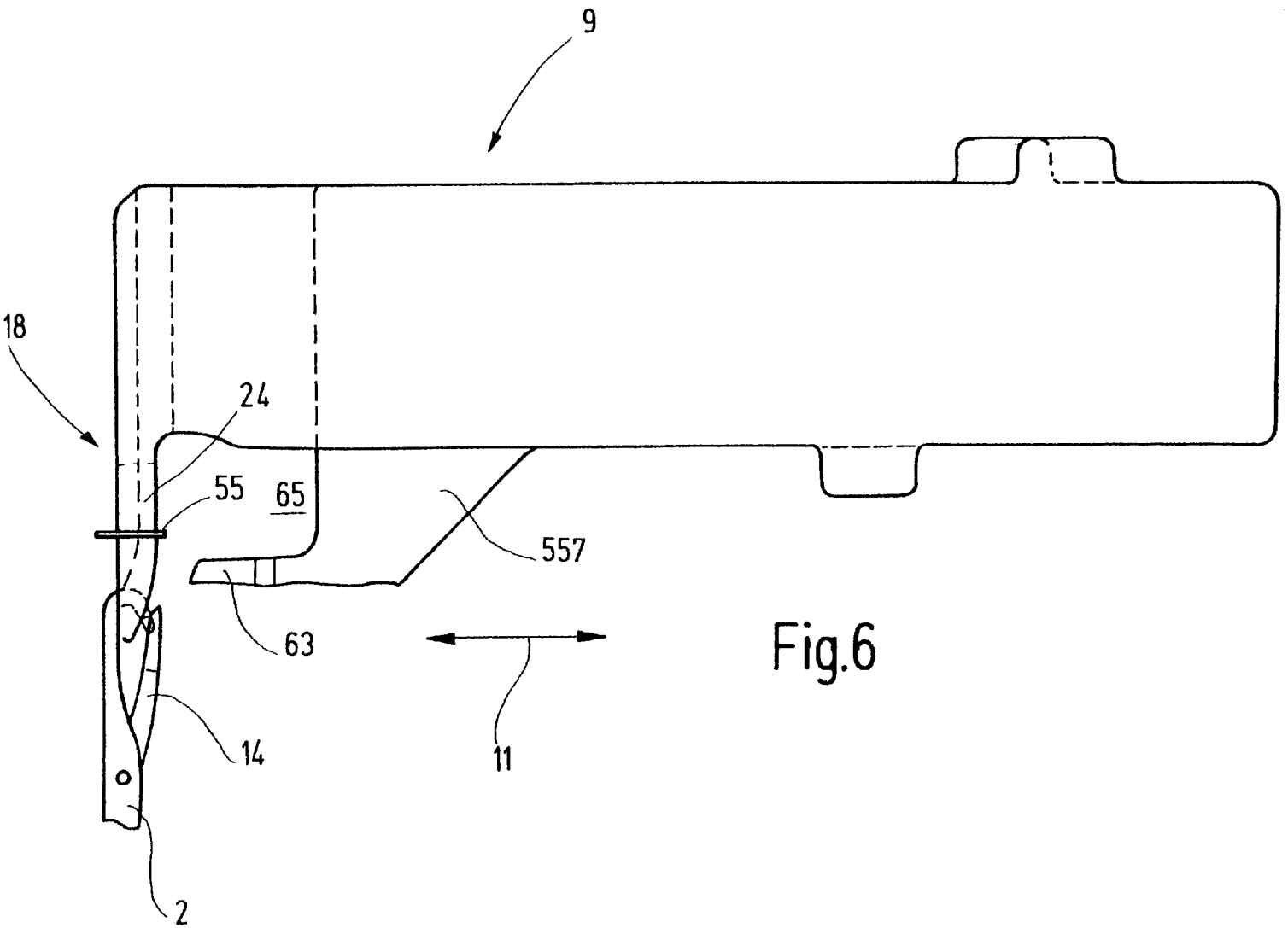
FIG. 6 shows the needle and plate of FIG. 4 following the loop transfer, with the closing plate.

Once the loop 55 has been transferred over the head of the needle 2 onto the loop-carrying section 18, the state illustrated in FIG. 6 is achieved. With this, the loop 55 has entered the loop-holder space 65. Now the closing plate 257 is moved in the longitudinal direction 11 in such a way that its protrusion 63 enters into the free space 24 in order to close the loop-holder space 65. When this has taken place, the hook of the needle 2 is moved out of the free space 24. This occurs in that initially the plate 9 and the needle 2 in FIG. 6 are only slightly displaced vertically in respect to each other, so that the location 27 comes out of the hook interior into the area of the latch 14. Then the plate 9 is moved in the opening direction of the latch 14, i.e. to the right in FIG. 6. Thus the loop-carrying section 18 is uncoupled from the needle 2. The latter can now be moved vertically downward away from the plate 9.

Figure 2:
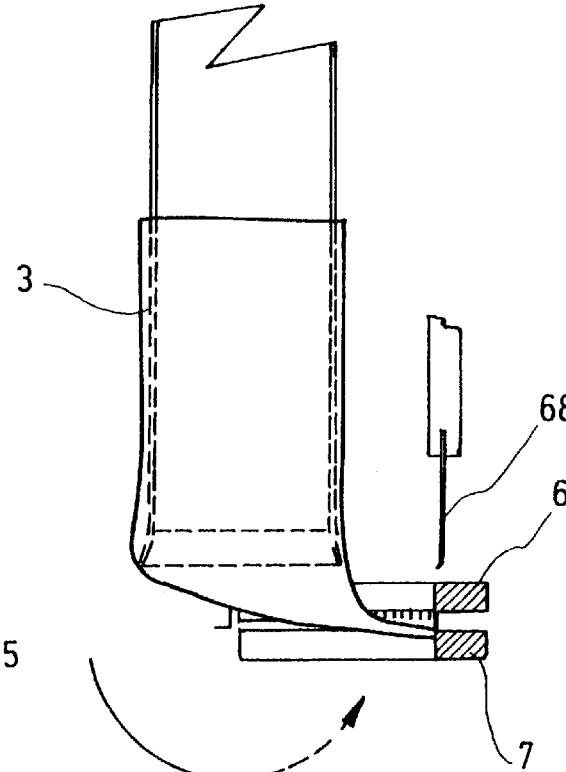
FIG. 2 is a schematic representation of the closing device and the folded-together stocking prior to the transfer to a sewing device.

The transfer of the loops 56 to the counter-plate 13 of the plate carrier section 7 takes place in a completely analogous manner. Thus, all loops of the knit fabric 3, which were lying on the needles 1, 2 before, have been transferred to the plates 9 and counter-plates 13 of the closing device 4. In this state the plate carrier section, which is spread in a ring shape, can be moved to a suitable location, after which the plate carrier section 7 is rotated around an axis, as indicated by an arrow 67 in FIG. 2, in such a way that it lies congruently opposite the plate carrier section 6. In the course of this, the counter-plates 13 and the plates 9, which lie opposite each other in respect to the swivel axis, meet so that finally each pair of plate and counter-plate comes together, as illustrated in FIG. 7. In the course of this the edge 51 formed by the ends of the legs 42, 43 comes into the receiving funnel 28 of the plate 9. Here, the exact penetration depth is of lesser importance. If, based on tolerance or dynamically caused deviations, the edge 51 of the counter-plate is pushed a little too far into the receiving funnel 28, the legs 22, 23 can resiliently yield, without causing damage to the plate 9.

After the edges 51 of all counter-plates 13 have found their way into the respectively assigned receiving funnel 28 of the oppositely located plate 9, the closing plates 57, 58 are moved away from the loop-carrying section 18, 41, as represented in FIG. 7, in order to open the loop-holder spaces 65, 66. A relative movement between the knit fabric 3 and the closing device 4, in particular of the plates 9 and counter-plates 13, now causes the loop 55 to slide from the loop-carrying section 18 onto the loop-carrying section 41. This can be caused by a movement of the knit fabric, as well as a mutual movement of the plates 9 and the counter-plates 13. After the loop 55 has been transferred to the counter plate 13, the loop-holder space 66 can be closed again by means of an appropriate movement of the closing plate 58. The loops 55, 56 of the knit fabric 3 which are located opposite each other, are now held in pairs in the loop-holder spaces 66 of the counter-plates 13, as well as in the respectively associated closing plates 58. As illustrated schematically in FIG. 2, they can now be taken over by loop-pickup fingers 68 of a sewing device. In the course of this the loop-pickup fingers 68 enter into the groove 52 of the counter-plate 13, visible in FIG. 9. The pair constituted by the loops 55, 56 can now be removed following the opening of the loop-holder space 66 and sewn together.

Figure 3:
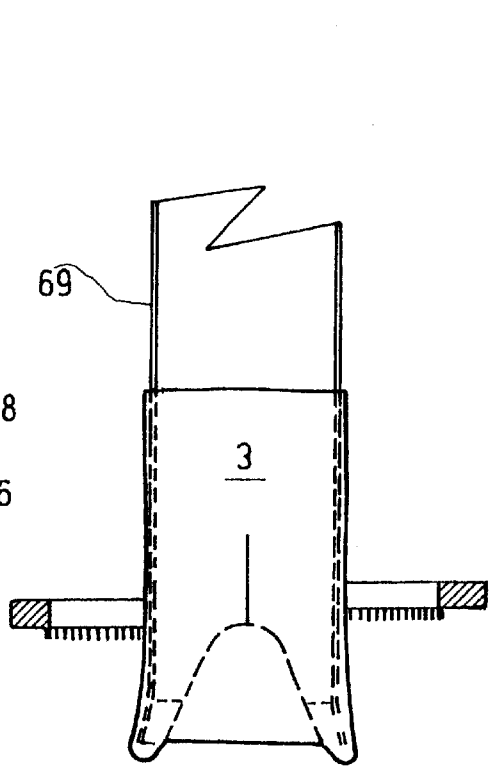
FIG. 3 shows a closed stocking in the course of being removed from the machine.

FIG. 3 then shows the removal of the knit fabric 3, closed at the end, from the closing device 4, for example in that it is aspirated off through a holding tube 69, over whose exterior it had been maintained stretched in the course of producing the knit fabric.

A closing device 4 is provided for closing a tube-shaped knit fabric on one end, for example for producing stockings or socks, which has plates 9 and counter-plates 13. The latter each have loop-carrying sections 18, 41, whose ends are designed to be complementary to each other and can engage each other in an interlocked manner. Here, the plates 9 have a receiving end, and the counter-plates 13 a penetrating end. The receiving end is constituted by a receiving funnel 28, formed by the ends of two legs 22, 23. These can be resiliently bent away from each other.

This has the advantage that the penetrating counter-plate 13 cannot cause any damage to the plate 9 if it is moved too far in the direction toward the plate 9. There is the further advantage that in the course of the dipping movement of the needle into the free space of the plate, as well as during the relative movements between the needle and the plate, damages are almost impossible.

What is claimed is:

1. A plate (9) for a closing device (4) for closing a tube-shaped knit fabric (3), in particular in connection with the manufacture of hosiery, having a base section (15), which is equipped to be guided in a longitudinal movement in a guide channel (8) of a plate carrier (6) and has at least one foot (16), which is used for the controlled longitudinal displacement of the plate (9), having a loop-carrying section (18) formed on the base section (15) and extending away from it, wherein the loop-carrying section (18) has two legs (22, 23), which are arranged at a distance from each other, are curved toward each other near their ends (25, 26) in order to closely approach or to touch each other at a location (27), and wherein the ends (25, 26) of the legs (22, 23) diverge away from each other, starting at the location (27), in order to constitute a receiving funnel (28) between them.

2. The plate in accordance with claim 1, characterized in that the legs (22, 23) resiliently rest against each other at the location (27).

3. The plate in accordance with claim 1, characterized in that the legs (22, 23) rest against each other under pretension.

4. The plate in accordance with claim 1, characterized in that the receiving funnel (28) defines an opening angle between 20° and 40°.

5. The plate in accordance with claim 1, characterized in that the receiving funnel (28) has an opening angle of 30°.

6. The plate in accordance with claim 1, characterized in that the legs (22, 23) are of a thickness which is less than one-half the thickness of the base section (15).

7. The plate in accordance with claim 1, characterized in that the legs (22, 23) and the base section (15) are embodied as one piece.

8. The plate in accordance with claim 1, characterized in that the loop-carrying section (18) is oriented transversely in respect to the base section (15).

9. The plate in accordance with claim 1, characterized in that the loop-carrying section (18) and the base section (15) enclose a right angle between them.

10. The plate in accordance with claim 1, characterized in that the loop-carrying section (18) is equipped to receive loops.

11. The plate in accordance with claim 1, characterized in that a free space (24) is formed in the loop-carrying section (18) between the legs (22, 23), which is designed for receiving a needle head, as well as for receiving a section of a closing plate (57).

12. A counter-plate (13) for a closing device (4) for closing a tube-shaped knit fabric (3), in particular in connection with the manufacture of hosiery, having a base section (35), which is equipped to be guided in a longitudinal movement in a guide channel (12) of a counter-plate carrier (7) and has at least one foot (38), which is used for the controlled longitudinal displacement of the counter-plate (13), having a loop-carrying section (41) designed for receiving loops (55, 56), formed on the base section (35) and extending away from it, wherein the loop-carrying section (41) has two legs (42, 43), which are arranged at a distance from each other, are curved toward each other near their ends (46, 47) in order to approach or to touch each other at a location (48), and wherein the legs (42, 43) terminate in an edge (51) at the location (48), which fits into the receiving funnel (28) of the plate (9).

13. The counter-plate in accordance with claim 12, characterized in that a free space (45) is formed in the loop-carrying section (41) between the legs (42, 43), which is designed for receiving a needle head, as well as for receiving a section of a closing plate (58).

14. The counter-plate in accordance with claim 12, characterized in that the legs (42, 43) resiliently rest against each other at the location (48).

15. The counter-plate in accordance with claim 12, characterized in that the legs (42, 43) rest against each other under pretension.

16. The counter-plate in accordance with claim 12, characterized in that the loop-carrying section (41) is oriented transversely in respect to the base section (35).

17. The counter-plate in accordance with claim 12, characterized in that the loop-carrying section (41) and the base section (35) enclose a right angle between them.

18. The counter-plate in accordance with claim 12, characterized in that on its side facing away from the base section (35), the loop-carrying section (41) has a groove (52).

19. The counter-plate in accordance with claim 18, characterized in that the groove (52) has diverging groove walls (53, 54).

* * * * *